US005879224A

United States Patent [19]

Pilger

[11] Patent Number: 5,879,224

[45] Date of Patent: Mar. 9, 1999

[54] REEL ASSEMBLY GRINDER WITH AUTOMATIC INDEXING AND GRINDING CONTROL

[76] Inventor: Mark Pilger, 420 Roberts Rd., Oldsmar, Fla. 34677

[21] Appl. No.: 782,370

[22] Filed: Jan. 13, 1997

[51] Int. Cl.[6] ..... B24B 3/42

[52] U.S. Cl. ..... 451/141; 451/403

[58] Field of Search ..... 451/141, 403, 451/372, 421

[56] References Cited

U.S. PATENT DOCUMENTS

| | | | |
|---|---|---|---|
| 2,281,055 | 4/1942 | Smith | 451/141 |
| 2,377,126 | 5/1945 | Brown | 451/141 |
| 4,148,158 | 4/1979 | Hewitt | 451/141 |
| 5,549,508 | 8/1996 | Searle et al. | 451/141 |

*Primary Examiner*—Robert A. Rose

[57] ABSTRACT

A reel assembly grinder with automatic indexing and grinding control including a conventional reel assembly with a cylindrical configuration. The reel assembly has a central axial shaft with a plurality of twisted blades situated therearound in a generally parallel orientation with respect to the shaft. Further provided is a grinding wheel. A reel drive mechanism is adapted to be coupled to the shaft of the reel assembly so that the blades of the reel assembly rotate while abutting the grinding wheel to effect spin grinding. The reel drive mechanism is further adapted to abut a single blade against the grinding wheel with a constant torque to effect relief grinding. Finally, a guide assembly is situated adjacent the grinding wheel. The guide assembly has two adjustable reel blade stops situated on either side of the grinding wheel. The guide assembly also includes at least one indexing blade guide pivotally coupled at a first end thereof adjacent an axis of rotation of the grinding wheel and further extended upwardly and rearwardly. Also included are front and rear adjusters for selectively adjusting the degree to which the indexing reel blade guide may pivot. In use, during relief grinding, the reel drive mechanism is adapted to abut a single blade against the grinding wheel with a constant torque and the grinding wheel is adapted to translate along a length of the blade of the assembly until the present reel blade abuts the reel blade stops thereby precluding further grinding. The grinding wheel may be translated past the reel assembly whereat the indexing reel blade guide is adapted to catch a next blade for grinding.

7 Claims, 3 Drawing Sheets

REEL ASSEMBLY GRINDER WITH AUTOMATIC INDEXING AND GRINDING CONTROL

BACKGROUND OF THE INVENTION

1. Field of the Invention

The present invention relates to a reel assembly grinder with automatic indexing and grinding control and more particularly pertains to providing an indexing assembly which both allows automatic indexing and further controls the nature which the blade is ground during relief grinding.

2. Description of the Prior Art

The use of reel assembly grinders is known in the prior art. More specifically, reel assembly grinders heretofore devised and utilized for the purpose of sharpening blades of a reel assembly are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,621,456 to Winstanley; U.S. Pat. No. 5,012,617 to Winstanley; 4,148,158 to Hewitt; U.S. Pat. No. 4,192,103 to Sousek; and U.S. Pat. No. 4,694,613 to Bernhard.

In this respect, the reel assembly grinder with automatic indexing and grinding control according to the present invention substantially departs from the conventional concepts and designs of the prior art, and in so doing provides an apparatus primarily developed for the purpose of providing an indexing assembly which both allows automatic indexing and further controls the nature which the blade is ground during relief grinding.

Therefore, it can be appreciated that there exists a continuing need for a new and improved reel assembly grinder with automatic indexing and grinding control which can be used for providing an indexing assembly which both allows automatic indexing and further controls the nature which the blade is ground during relief grinding. In this regard, the present invention substantially fulfills this need.

SUMMARY OF THE INVENTION

In view of the foregoing disadvantages inherent in the known types of reel assembly grinders now present in the prior art, the present invention provides an improved reel assembly grinder with automatic indexing and grinding control. As such, the general purpose of the present invention, which will be described subsequently in greater detail, is to provide a new and improved reel assembly grinder with automatic indexing and grinding control which has all the advantages of the prior art and none of the disadvantages.

To attain this, the present invention essentially comprises a conventional reel assembly with a cylindrical configuration. The reel assembly has a central axial shaft with a plurality of twisted blades situated therearound in a generally parallel orientation with respect to the shaft. As shown in FIG. 1, a steel table with a rectilinear configuration is included having a top face, an open front face, an open rear face, and a pair of side faces integrally formed with the top face and depending downwardly therefrom. The table further has a plurality of track shafts coupled between the side faces beneath the top face. The top face has a slot formed along the length thereof between the side faces. The side faces each have a horizontally orientated support bar coupled at both ends thereof to the side face with a space situated therebetween. With reference still to FIG. 1, a grinding wheel assembly includes a grinding wheel adapted to rotate about a horizontal axis. Further provided is motor for effecting the rotation of the grinding wheel. For supporting the grinding wheel and motor, a pneumatic carriage drive mechanism is coupled between the grinding wheel and the track shafts of the table, whereby the pneumatic carriage drive mechanism is adapted to allow the translation of the grinding wheel along the length of the slot of the table. In addition, the pneumatic carriage is further adapted to allow the grinding wheel to be raised and lowered via a single point grinding wheel infeed. For controlling the reel assembly during both relief and spin grinding, a reel drive mechanism is coupled to the support bar of the table and extended slightly above the top surface thereof. The reel drive mechanism has a motor adapted to be coaxially coupled to the shaft of the reel assembly via an extension member. In operation, the shaft of the reel assembly is positioned above and aligned with the slot of the table such that the blades of the reel assembly abut the grinding wheel. Upon actuation thereof in a first mode of operation, the reel drive mechanism is adapted to rotate the reel assembly with respect to the grinding wheel for effecting the spin grinding of the reel assembly. The reel drive mechanism is further adapted to abut a single blade against the grinding wheel with a constant torque in a second mode of operation to effect relief grinding of the blade of the reel assembly. For both controlling the grinding of a blade and further allowing automatic indexing of the blade during relief grinding, a guide assembly is situated adjacent to the grinding wheel. The guide assembly includes a support block coupled adjacent the grinding wheel near an axis of rotation thereof. Attached to the block are two adjustable reel blade stops on either side of the grinding wheel. At least one reel blade guide is pivotally coupled at a first end thereof to the support block and extended upwardly and rearwardly. Further provided is a front adjuster for selectively adjusting the degree to which the indexing reel blade guide may pivot forwardly. Associated therewith is a rear adjuster for selectively adjusting the degree to which the indexing reel blade guide may pivot rearwardly. Finally, a spring is coupled between the front adjuster and a midpoint of the indexing reel blade guide. By this structure during relief grinding, the reel drive mechanism is adapted to abut a single blade against the grinding wheel with a constant torque and further translate the grinding wheel along a length of the blade of the assembly the blade being ground until the reel blade abuts the reel blade stops thereby precluding further grinding. At the end of each pass the grinding wheel will be translated slightly past the reel assembly such that another blade of the reel assembly abuts the indexing reel blade guide for allowing the grinding thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reel assembly grinder with automatic indexing and grinding control which has all the advantages of the prior art reel assembly grinders and none of the disadvantages.

It is another object of the present invention to provide a new and improved reel assembly grinder with automatic indexing and grinding control which may be easily and efficiently manufactured and marketed.

It is a further object of the present invention to provide a new and improved reel assembly grinder with automatic indexing and grinding control which is of a durable and reliable construction.

An even further object of the present invention is to provide a new and improved reel assembly grinder with automatic indexing and grinding control which is susceptible of a low cost of manufacture with regard to both materials and labor, and which accordingly is then susceptible of low prices of sale to the consuming public, thereby making such reel assembly grinder with automatic indexing and grinding control economically available to the buying public.

Still yet another object of the present invention is to provide a new and improved reel assembly grinder with automatic indexing and grinding control which provides in the apparatuses and methods of the prior art some of the advantages thereof, while simultaneously overcoming some of the disadvantages normally associated therewith.

Still another object of the present invention is to provide an indexing assembly which both allows automatic indexing and further controls the nature which the blade is ground during relief grinding.

Still yet another object of the present invention is to maintain a reel assembly in abutment with a grinding wheel with a constant torque for consistent sharping of the blades thereof during relief grinding.

Another object of the present invention is to control the depth of grinding of a blade of a reel assembly during relief grinding.

Lastly, it is an object of the present invention to provide a new and improved reel assembly grinder with automatic indexing and grinding control including a conventional reel assembly with a cylindrical configuration. The reel assembly has a central axial shaft with a plurality of twisted blades situated therearound in a generally parallel orientation with respect to the shaft. Further provided is a grinding wheel. A reel drive mechanism is adapted to be coupled to the shaft of the reel assembly so that the blades of the reel assembly rotate while abutting the grinding wheel to effect spin grinding. The reel drive mechanism is further adapted to abut a single blade against the grinding wheel with a constant torque to effect relief grinding. Finally, a guide assembly is situated adjacent the grinding wheel. The guide assembly includes two adjustable reel blade stops and an indexing reel blade guide pivotally coupled at a first end thereof adjacent an axis of rotation of the grinding wheel and further extended upwardly and rearwardly. Also included front and rear adjusters for selectively adjusting the degree to which the indexing grinder stop may pivot. In use, during relief grinding, the reel drive mechanism is adapted to abut a single blade against the grinding wheel with a constant torque and the grinding wheel is adapted to translate along a length of the blade of the assembly until the reel blade abuts the reel blade stops thereby precluding further grinding. At the end of each pass the grinding wheel will be translated past the reel assembly whereat the indexing grinder stop is adapted to catch a next blade for grinding. The blades will continue to index until grinding is complete.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
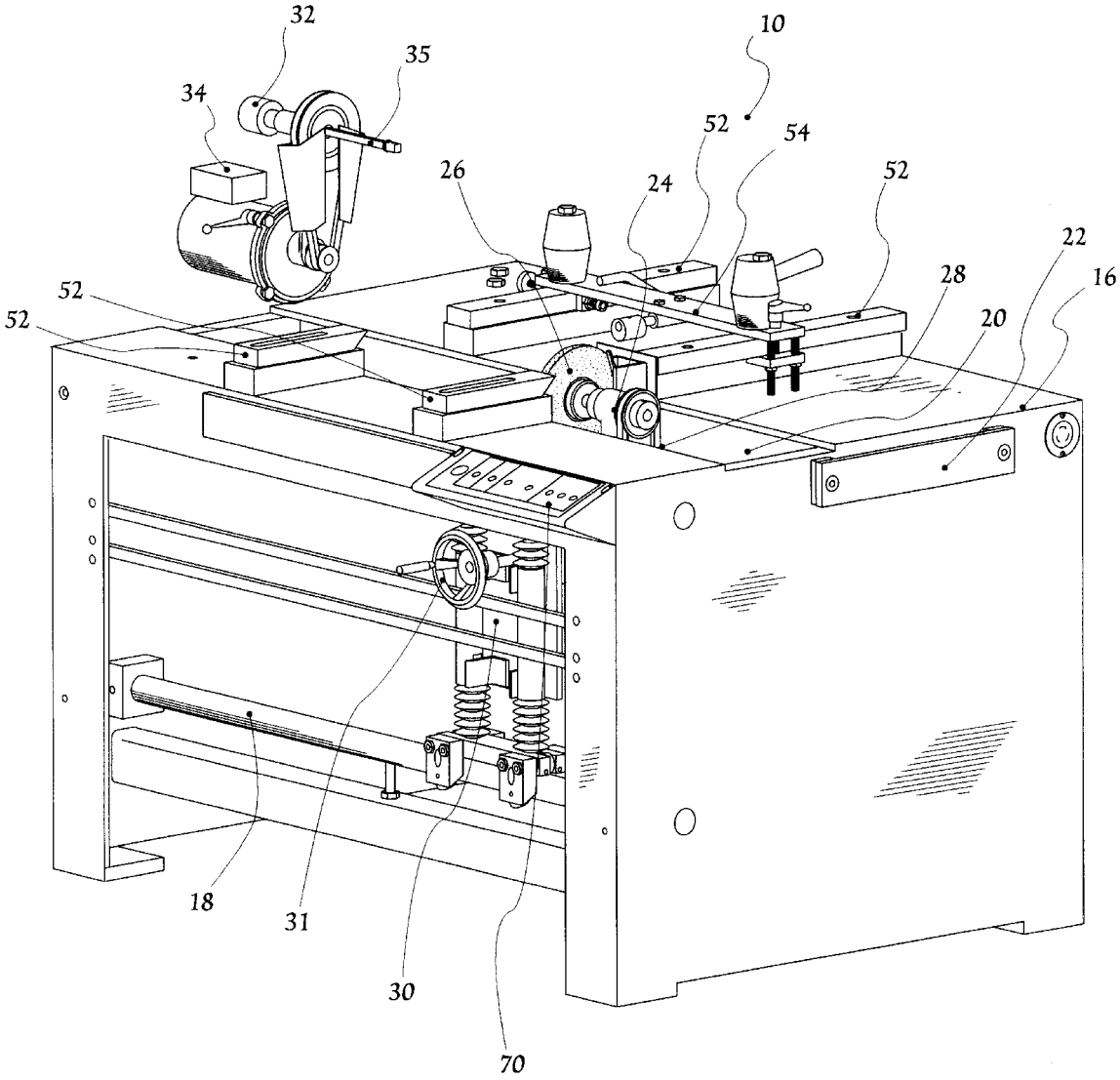
FIG. 1 is a perspective illustration of the preferred embodiment of the reel assembly grinder with automatic indexing and grinding control constructed in accordance with the principles of the present invention.
Figure 2:
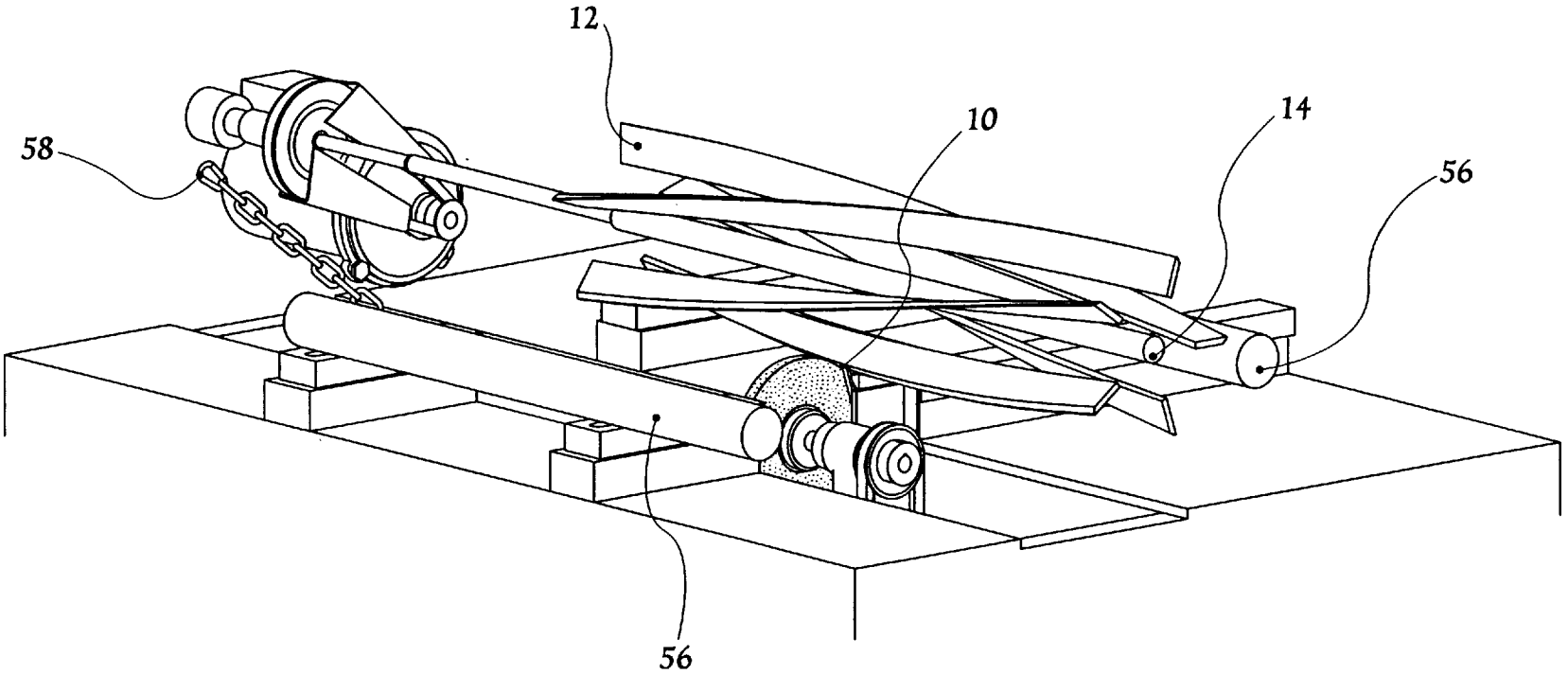
FIG. 2 is a close up perspective view of the present invention in use with the reel assembly attached.

With reference now to the drawings, and in particular to FIG. 1 thereof, a new and improved reel assembly grinder with automatic indexing and grinding control embodying the principles and concepts of the present invention and generally designated by the reference numeral 10 will be described.

The present invention, the new and improved reel assembly grinder with automatic indexing and grinding control, is comprised of a plurality of components. Such components in their broadest context include a reel assembly, table, grinding wheel assembly, reel drive mechanism, and guide assembly. Such components are individually configured and correlated with respect to each other so as to attain the desired objective.

More specifically, it will be noted that the system 10 of the present invention includes a conventional reel assembly 12 with a cylindrical configuration. The reel assembly has a central axial shaft 14 with a plurality of twisted blades situated therearound in a generally parallel orientation with respect to the shaft.

As shown in FIG. 1, a steel table 16 with a rectilinear configuration is included having a top face, an open front face, an open rear face, and a pair of side faces integrally formed with the top face and depending downwardly therefrom. The table further has a plurality of track shafts 18 coupled between the side faces beneath the top face. The top face has a slot 20 formed along the length thereof between the side faces. For reasons that will become apparent later, the side faces have horizontally orientated support bars 22 coupled at both ends thereof to the side face with a space situated therebetween.

With reference still to FIG. 1, a grinding wheel assembly 24 includes a grinding wheel 26 adapted to rotate about a horizontal axis in a clockwise direction. Further provided is motor 28 for effecting the rotation of the grinding wheel. For supporting the grinding wheel and motor, a pneumatic driven carriage 30 drive mechanism is coupled between the grinding wheel and the track shafts of the table, whereby the pneumatic driven carriage drive mechanism is adapted to allow the translation of the grinding wheel along the length of the slot of the table. In addition, the pneumatic driven carriage is further adapted to allow the grinding wheel to be raised and lowered via a single point grinding wheel infeed 31.

Figure 3:
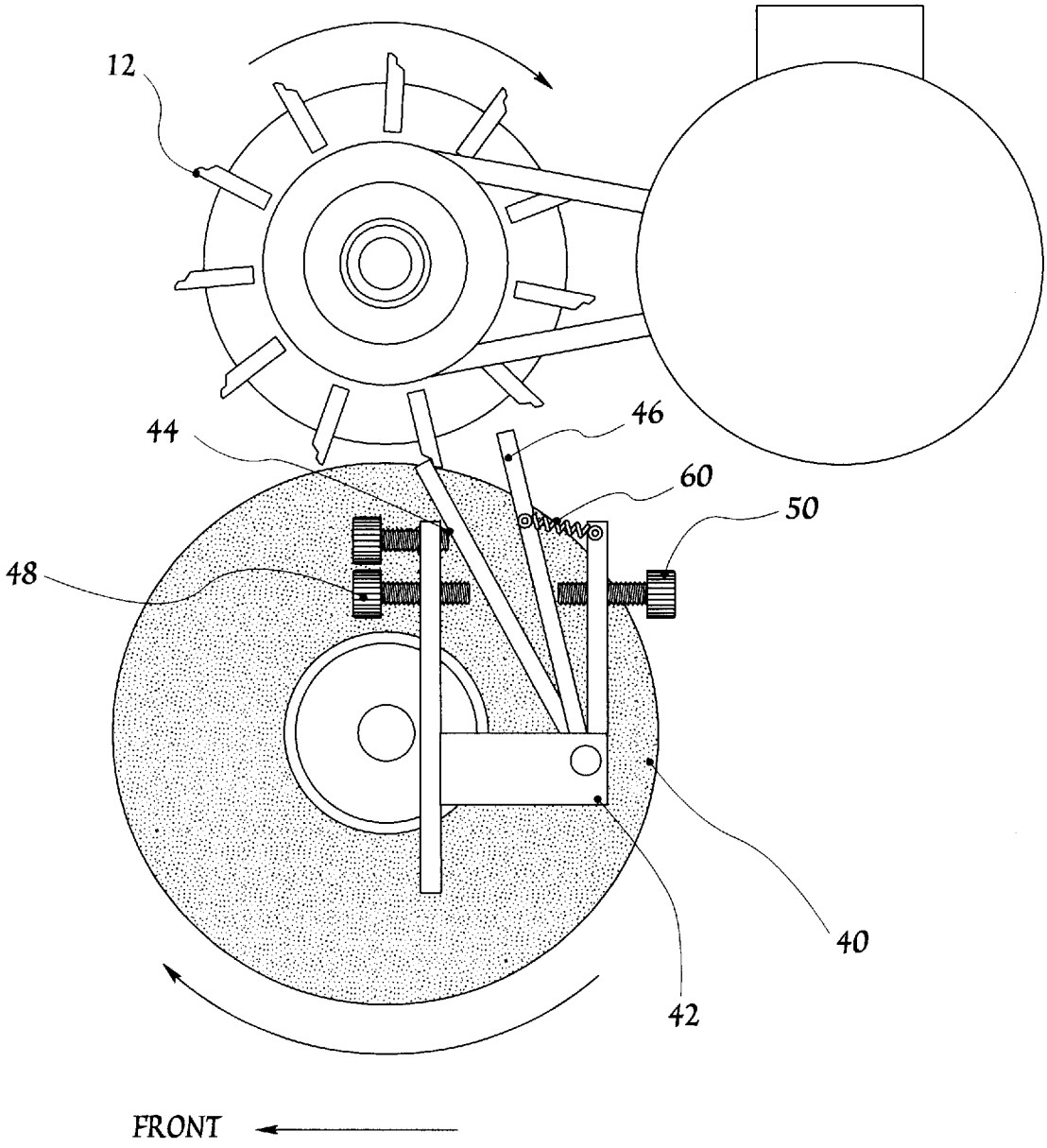
FIG. 3 is a side elevational view of the indexing assembly of the present invention.

For controlling the reel assembly during both relief and spin grinding, a reel drive mechanism 32 is coupled to the support bar of the table and extended slightly above the top surface thereof. The reel drive mechanism has a motor 34 adapted to be coaxially coupled to the shaft of the reel assembly via an extension member 35. In operation, the shaft of the reel assembly is positioned above and aligned with the slot of the table such that the blades of the reel assembly abut the grinding wheel. Upon actuation of the reel drive mechanism in a first mode of operation, the reel drive mechanism is adapted to rotate the reel assembly with respect to the grinding wheel for effecting the spin grinding of the reel assembly. Such grinding is conventional in the art for reducing the conical shape of the blades of the reel assembly and to sharpen the edge of the blade. The reel drive mechanism is further adapted to abut a single blade against the grinding wheel with a constant torque upon the actuation thereof in a second mode of operation to effect relief grinding of the blade of the reel assembly. Such is accomplished via a clutch mechanism coupled in coaxial relation with the motor of the reel drive mechanism. The reel is rotated in a clockwise direction as shown in FIG. 3.

For both controlling the grinding of a blade and further allowing automatic indexing thereof during relief grinding, a guide assembly 40 is situated adjacent to the grinding wheel. The guide assembly includes a support block 42 fixedly coupled adjacent the grinding wheel near an axis of rotation thereof. A pair of adjustable reel blade stops 44 are situated on either side of the grinding wheel. An indexing reel blade guide 46 is pivotally coupled at a first end thereof to the support block and extended upwardly and forwardly on one or both sides of the grinding wheel. As such, the indexing reel blade guide extends upwardly and toward the front of the table. Further provided is a front adjuster 48 for selectively adjusting the degree to which the indexing grinder stop may pivot forwardly. The front adjuster comprises a manually driven screw rotatably mounted within a threaded aperture formed in the support block and adapted to translate within the horizontal plane. Associated therewith is a rear adjuster 50 for selectively adjusting the degree to which the indexing grinder stop may pivot rearwardly. Similar to the front adjuster, the rear adjuster also comprises a manually driven screw rotatably mounted within a threaded aperture formed in the support block. Finally, a spring 60 is coupled between the support block adjacent the rear adjuster and a midpoint of the indexing reel blade guide.

During relief grinding, the reel drive mechanism is adapted to abut a single blade against the grinding wheel with a constant torque. In addition, the grinding wheel is adapted to translate along a length of the blade of the assembly with one of the indexing grinder stops abutting the blade being ground until the reel blade abuts the reel blade stop precluding further grinding. The grinding wheel and reel blade stops will continue slightly past the reel assembly such that another blade of the reel assembly may be spun to abut the reel blade guide. This process is repeated until all of the blades are ground. To facilitate the translation of the grinding wheel assembly along a distance slightly greater than the length of the blade, a plurality of adjustable grinder stops may be attached to the track shafts to constrain the translation of the pneumatic carriage drive mechanism. While relief grinding in accordance with the method discussed hereinabove, the grinding angle of the blades of the reel assembly is controlled by adjusting the adjuster of the reel blade stops to dictate at which point the reel blade stops precludes further grinding of the blades.

To ensure that the reel assembly is in proper position before grinding in that it is parallel to the grinding wheel travel, the present invention includes front and rear reel support rails 52 which are manufactured to be precisely parallel to the track shafts 18 for vertical alignment. The invention also includes a self-aligning rear fence 54 which can be moved on and clamped to the rear reel support rails to properly position different size reels. The rollers 56 of the reel assembly sit on the front and rear reel support rails and the rear roller resets against the fence, pneumatic chain clamps 58 hold the reel assembly in place. This ensures that the bottom of the reel blades is ground parallel to the bottom of the rollers therefore ensuring that the reel assembly has a consistent height of cut across its full width.

For manually controlling the operation of the grinding wheel assembly and reel drive assembly, a control panel 70 is conveniently positioned adjacent the front face of the table.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved reel assembly grinder with automatic indexing and grinding control for use with a conventional reel assembly with a cylindrical configuration, the reel assembly having a central axial shaft with a plurality of twisted blades situated therearound in a generally parallel orientation with respect to the shaft, the real assembly grinder comprising, in combination:

a steel table with a rectilinear configuration having a top face, an open front face, an open rear face, and a pair of side faces integrally formed with the top face and depending downwardly therefrom, the table further comprising a plurality of track shafts coupled between the side faces beneath the top face, the top face having a slot formed along the length thereof between the side faces, the side faces each having a horizontally orientated support bar coupled at both ends thereof to the side face with a space situated there between;

a grinding wheel assembly having a grinding wheel adapted to rotate about a horizontal axis, a motor for effecting the rotation of the grinding wheel, and a pneumatic carriage drive mechanism coupled between the grinding wheel and the track shafts of the table for supporting the grinding wheel and motor, whereby the pneumatic carriage drive mechanism is adapted to allow the translation of the grinding wheel along the length of the slot of the table and further allow the grinding wheel to be raised and lowered via a single point grinding wheel infeed;

a reel drive mechanism coupled to the support bar of the table and extending slightly above the top surface thereof, the reel drive mechanism having a motor adapted to be coaxially coupled to the shaft of the reel assembly, wherein the shaft of the reel assembly is positioned above and aligned with the slot of the table so that the blades of the reel assembly abut the grinding wheel, the reel drive mechanism adapted to rotate the reel assembly with respect to the grinding wheel upon actuation thereof in a first mode of operation for effecting the spin grinding of the reel assembly and further adapted to abut a single blade against the grinding wheel with a constant torque upon actuation thereof in a second mode of operation to effect relief grinding of the blade of the reel assembly;

a guide assembly situated adjacent to the grinding wheel, the guide assembly including a support block coupled adjacent the grinding wheel near an axis of rotation thereof, two adjustable reel blade stops one on each side of the grinding wheel; and an indexing reel blade guide pivotally coupled at a first end thereof to the support block and extended upwardly and forward, a front adjuster for selectively adjusting the degree to which the indexing grinder stop may pivot forwardly, a rear adjuster for selectively adjusting the degree to which the indexing grinder stop may pivot rearwardly, and a spring coupled between the rear adjuster and a midpoint of the indexing reel blade guide, whereby during relief grinding, the reel drive mechanism is adapted to abut a single blade against the grinding wheel with a constant torque and the grinding wheel is adapted to be translated along a length of the blade of the assembly until the present reel blade abuts the reel blade stops thereby precluding further grinding, the grinding wheel and reel blade stops being translated slightly past the reel assembly such that another blade of the reel assembly abuts the indexing reel blade guide for allowing grinding thereof.

2. A reel assembly grinder for use with a conventional reel assembly with a cylindrical configuration, the reel assembly having a central axial shaft with a plurality of twisted blades situated therearound in a generally parallel orientation with respect to the shaft, the reel assembly grinder comprising:

a grinding wheel adapted to translate along a length of the reel assembly;

a reel drive mechanism adapted to be coupled to the shaft of the reel assembly so that the blades of the reel assembly abut the grinding wheel, the reel drive mechanism adapted to abut a single blade against the grinding wheel with a constant torque upon the actuation thereof to effect relief grinding of the blade of the reel assembly; and a guide assembly situated adjacent to the grinding wheel, the guide assembly including two adjustable reel blade stops, a reel blade guide pivotally coupled at a first end thereof adjacent the axis of rotation of the grinding wheel and further extended upwardly and forwardly and a front and rear adjuster for selectively adjusting the degree to which the indexing grinder stop may pivot, whereby during relief grinding, the reel drive mechanism is adapted to abut a single blade against the grinding wheel with a constant torque and the grinding wheel is adapted to be translated along a length of the blade of the assembly until the present reel blade abuts the adjustable reel blade stops adjuster thereby precluding further grinding.

3. A reel assembly grinder as set forth in claim 2 wherein the indexing means further includes a front adjuster for selectively adjusting the degree to which the indexing grinder stop may pivot.

4. A reel assembly grinder as set forth in claim 2 and further including a table with a rectilinear configuration having a top face, an open front face, an open rear face, and a pair of side faces integrally formed with the top face and depending downwardly therefrom, the table further comprising a plurality of track shafts coupled between the side faces beneath the top face, the top face having a slot formed along the length thereof between the side faces, one of the side faces having a horizontally orientated support bar coupled at both ends thereof to the side face with a space situated therebetween.

5. A reel assembly grinder as set forth in claim 2 wherein the grinding wheel may be raised and lowered via a single point grinding wheel infeed.

6. A reel assembly grinder as set forth in claim 2 wherein the reel drive mechanism is further adapted to rotate the reel assembly with respect to the grinding wheel while in abutment with the grinding wheel thereby effecting spin grinding.

7. A reel assembly grinder as set forth in claim 2 wherein a guide assembly resides adjacent to the grinding wheel and a spring is attached to the indexing reel blade guide for forcing it toward the blade in use, whereby the grinding wheel and reel blade stops may be translated slightly past the reel assembly such that another blade of the reel assembly abuts the indexing reel blade guide for allowing the grinding thereof thus affording automatic indexing.

* * * * *